US011786085B2

(12) United States Patent
Lewis et al.

(10) Patent No.: US 11,786,085 B2
(45) Date of Patent: Oct. 17, 2023

(54) MULTI-ROLL PAPER PRODUCT DISPENSER

(71) Applicant: Kimberly-Clark Worldwide, Inc., Neenah, WI (US)

(72) Inventors: Richard P. Lewis, Marietta, GA (US); Eric M. Chalko, Alpharetta, GA (US); Anita Neidert, Roswell, GA (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 34 days.

(21) Appl. No.: 17/607,709

(22) PCT Filed: Apr. 30, 2019

(86) PCT No.: PCT/US2019/030049
§ 371 (c)(1),
(2) Date: Oct. 29, 2021

(87) PCT Pub. No.: WO2020/222829
PCT Pub. Date: Nov. 5, 2020

(65) Prior Publication Data
US 2022/0218162 A1 Jul. 14, 2022

(51) Int. Cl.
*A47K 10/38* (2006.01)
*A47K 10/32* (2006.01)

(52) U.S. Cl.
CPC ..... *A47K 10/38* (2013.01); *A47K 2010/3253* (2013.01)

(58) Field of Classification Search
None
See application file for complete search history.

(56) References Cited

U.S. PATENT DOCUMENTS 3,650,487 A 3/1972 Bahnsen
3,677,485 A * 7/1972 Berg ..... A47K 10/3836 242/561
3,771,739 A * 11/1973 Nelson ..... A47K 10/38 242/561

(Continued)

FOREIGN PATENT DOCUMENTS

CN 103025219 A 4/2013
CN 205963925 U 2/2017

(Continued)

OTHER PUBLICATIONS

American Janitor & Paper Supply, "Dispensers for Tissue—GP Rollmastr® 3000® Vertical 2 Roll Tissue Dispenser", Americanjanitor.com, https://www.americanjanitor.com/catalog/Mobile/Catalog_Item_Detail.aspx?temno=FJ56716-EA.

*Primary Examiner* — William A. Rivera

(57) ABSTRACT

Systems, methods and apparatus for dispensing of paper products. A paper product dispenser comprising a housing comprising a back, two sides, and a product holding area defined by the back and two sides, wherein each of the two sides includes a vertical track and wherein one of the two sides is movably attached to the housing; and a support device configured to movably engage the vertical tracks of the first and second sides and to support a first roll and a second roll, vertically offset from one another, in the product holding area.

18 Claims, 10 Drawing Sheets

(56) References Cited

U.S. PATENT DOCUMENTS

| | | | | |
|---|---|---|---|---|
| 4,143,827 | A * | 3/1979 | Tucker | A47K 10/3836 242/560.3 |
| 4,206,858 | A | 6/1980 | DeLuca et al. | |
| 4,422,585 | A | 12/1983 | Schultz et al. | |
| 5,628,474 | A * | 5/1997 | Krueger | A47K 10/38 242/597.5 |
| 5,690,299 | A * | 11/1997 | Perrin | A47K 10/3836 242/597.5 |
| 5,873,542 | A * | 2/1999 | Perrin | A47K 10/3836 242/597.5 |
| 6,378,800 | B1 | 4/2002 | Apichom | |
| 6,508,432 | B2 | 1/2003 | Krivulin | |
| 6,752,349 | B2 * | 6/2004 | Moody | A47K 10/38 242/599.3 |
| 7,832,678 | B2 * | 11/2010 | Hjort | A47K 10/38 242/560.3 |
| 7,967,235 | B2 * | 6/2011 | Forman | B65H 49/322 242/597.5 |
| 10,105,020 | B2 | 10/2018 | Carper et al. | |
| 11,559,174 | B2 * | 1/2023 | Elliott | A47K 10/32 |
| 2003/0080237 | A1 | 5/2003 | Taylor et al. | |
| 2008/0245922 | A1 | 10/2008 | Fellhoelter | |
| 2009/0266928 | A1 | 10/2009 | Friesen et al. | |
| 2013/0320130 | A1 * | 12/2013 | Osborne, Jr. | A47K 10/3845 242/561 |
| 2015/0102048 | A1 | 4/2015 | Case et al. | |
| 2018/0263434 | A1 * | 9/2018 | Babikian | A47K 10/38 |
| 2021/0307569 | A1 * | 10/2021 | Ziebart | A47K 10/38 |

FOREIGN PATENT DOCUMENTS

| | | | |
|---|---|---|---|
| CN | 208624474 | U | 3/2019 |
| FR | 2451737 | A1 | 10/1980 |
| GB | 1339084 | A | 11/1973 |
| GB | 2029801 | A | 3/1980 |
| JP | H08498 | A | 1/1996 |
| JP | 3034777 | U | 3/1997 |
| JP | H09206238 | A | 8/1997 |
| JP | 2000242850 | A | 9/2000 |
| JP | 2002263034 | A | 9/2002 |
| JP | 3110532 | U | 6/2005 |
| JP | 3175809 | U | 5/2012 |

* cited by examiner

MULTI-ROLL PAPER PRODUCT DISPENSER

This disclosure generally relates to a consumable product dispensing system.

BACKGROUND

Systems dispensing consumable products are common in many environments today. For example, consumable product dispensers, e.g., bath tissue dispensers, are used in many private, semi-private and public washrooms. As such, it's desirable to ensure the dispensers are easy to load with product to reduce maintenance overhead/burden and ensure smooth operation for users after the loading process.

SUMMARY

In general, the subject matter of this specification relates to a paper product dispenser for rolled products such as bath tissue. One aspect of the subject matter described in this specification can be implemented in systems that include a paper product dispenser comprising a housing comprising a back, two sides, and a product holding area defined by the back and two sides, wherein each of the two sides includes a vertical track and wherein one of the two sides is movably attached to the housing; and a support device configured to movably engage the vertical tracks of the first and second sides and to support a first roll and a second roll, vertically offset from one another, in the product holding area. Other embodiments of this aspect include corresponding apparatus and methods.

Yet another aspect of the subject matter described in this specification can be implemented in systems that include a paper product dispenser comprising a housing comprising a back, two sides, and a product holding area defined by the back and two sides, wherein at least one of the two sides includes a vertical track and wherein one of the two sides is movably attached to the housing; and a support device configured to movably engage the vertical track and to support a first roll and a second roll, vertically offset from one another, in the product holding area. Other embodiments of this aspect include corresponding apparatus and methods.

Particular embodiments of the subject matter described in this specification can be implemented so as to realize one or more of the following advantages. For example, the dispenser has a side wall that is moveably attached to the dispenser housing so that the wall can be, for example, pivoted away from the housing to allow a roll to be more easily inserted or loaded into the housing.

In a two-roll holding configuration, the dispenser can include upper and lower roll holders for the upper and lower product rolls. The upper roll holder and roll are supported, at least in part, by the lower roll holder and lower roll such that as the lower roll depletes the upper roll holder and upper roll move down within the dispenser to be accessible by a user. In this way the user can use the lower roll and then access and use the upper roll when the lower roll is sufficiently depleted (and the upper roll drops down). As such, when not needed, the upper roll can remain, at least partially, in the dispenser housing and less exposed to the environment (and potentially reduce hygiene/contamination concerns). And when needed (e.g., when the lower roll is depleting or fully depleted), the upper roll drops down to be accessible to a user.

The details of one or more implementations of the subject matter described in this specification are set forth in the accompanying drawings and the description below. Other features, aspects, and advantages of the subject matter will become apparent from the description, the drawings, and the claims.

DESCRIPTION OF DRAWINGS

Like reference symbols in the various drawings indicate like elements.

DETAILED DESCRIPTION

The present disclosure generally relates to a rolled paper product dispenser.

In some implementations, the dispenser includes two opposing sides with each side have a vertical track running from top to bottom. The dispenser also includes a support device, for example, an upper and lower roll holder. Each roll holder includes right and left braces that insert into the respective vertical tracks and slide up and down in the tracks. For example, the right and left side upper braces of the upper roll holder hold a first roll and the right and left side lower braces of the lower roll holder hold a second roll with the lower roll holder supporting the upper roll holder (and upper roll) to prevent the upper roll from dropping lower in the tracks.

The lower roll holder supports the upper roll holder in such a way that as the lower roll depletes the upper roll holder (and therefore the upper roll) slide down the vertical tracks in proportion to the depletion of the lower roll. Thus as the lower roll depletes the upper roll is presented to the user to enable the dispenser to (sequentially) dispense two rolls. This allows the upper roll to be exposed to the user only as necessary (e.g., when the lower roll depletes or is depleted). The dispenser is described in more detail below with reference to FIG. 1, which is a representation of an example product dispenser 100, and FIG. 2, which is a representation of an example paper product dispenser 100 partially disassembled.

The dispenser 100 can be, for example, a bath tissue dispenser 100, hand towel dispenser, wipe/wiper dispenser or the like for rolled paper products 102. A paper product describes sheet materials made from cellulose fibers (e.g., wood pulp), synthetic fibers (e.g., polypropylene) or some combination thereof, and include, for example, bath tissue, paper towels and wipes/wipers including made from woven and nonwoven technologies. A rolled product (or roll) 102 is a product that is wound around a core or center axis.

Figure 1:
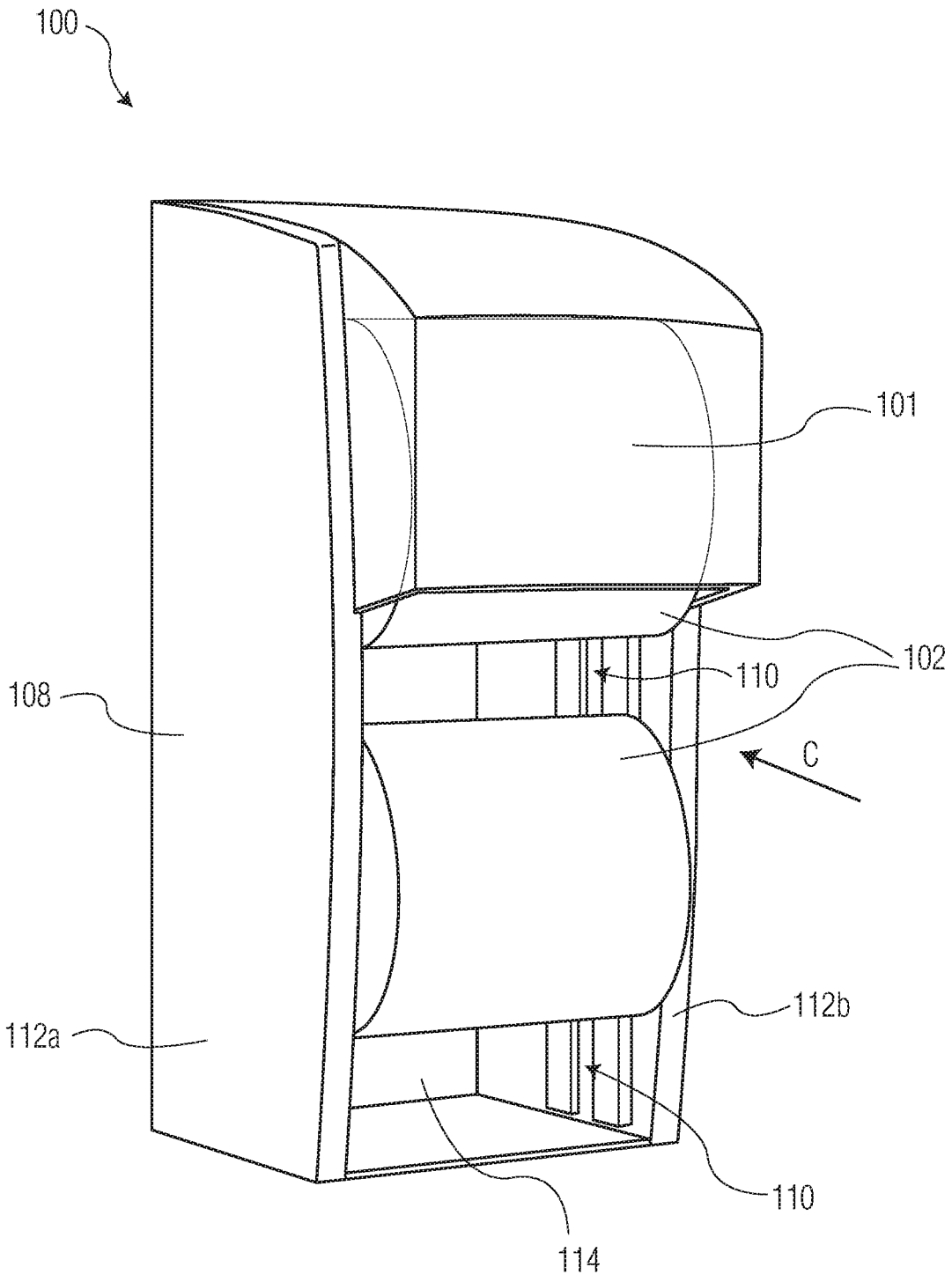
FIG. 1 is a representation of an example paper product dispenser.

The dispenser 100 includes a body or housing 108, e.g., a composite or metal housing. The dispenser 100 also includes a product holding area 110 to hold the rolled product 102 (roll 102). In some implementations, the housing 108 includes a back cover 114 (e.g., the side mounted or closest to the wall when installed in a typical configuration) and two sides 112*a* and 112*b*. As shown in FIG. 1, the housing 108 can, for example, include a front cover 101 to, in combination with one or more of the back cover 114, side 112*a* and/or 112*b*, fully or partially define and/or enclose the product holding area 110. Generally, the product holding area 110 is a space or cavity within the body 108 in which the roll(s) 102 can be positioned for dispensing.

Figure 2:
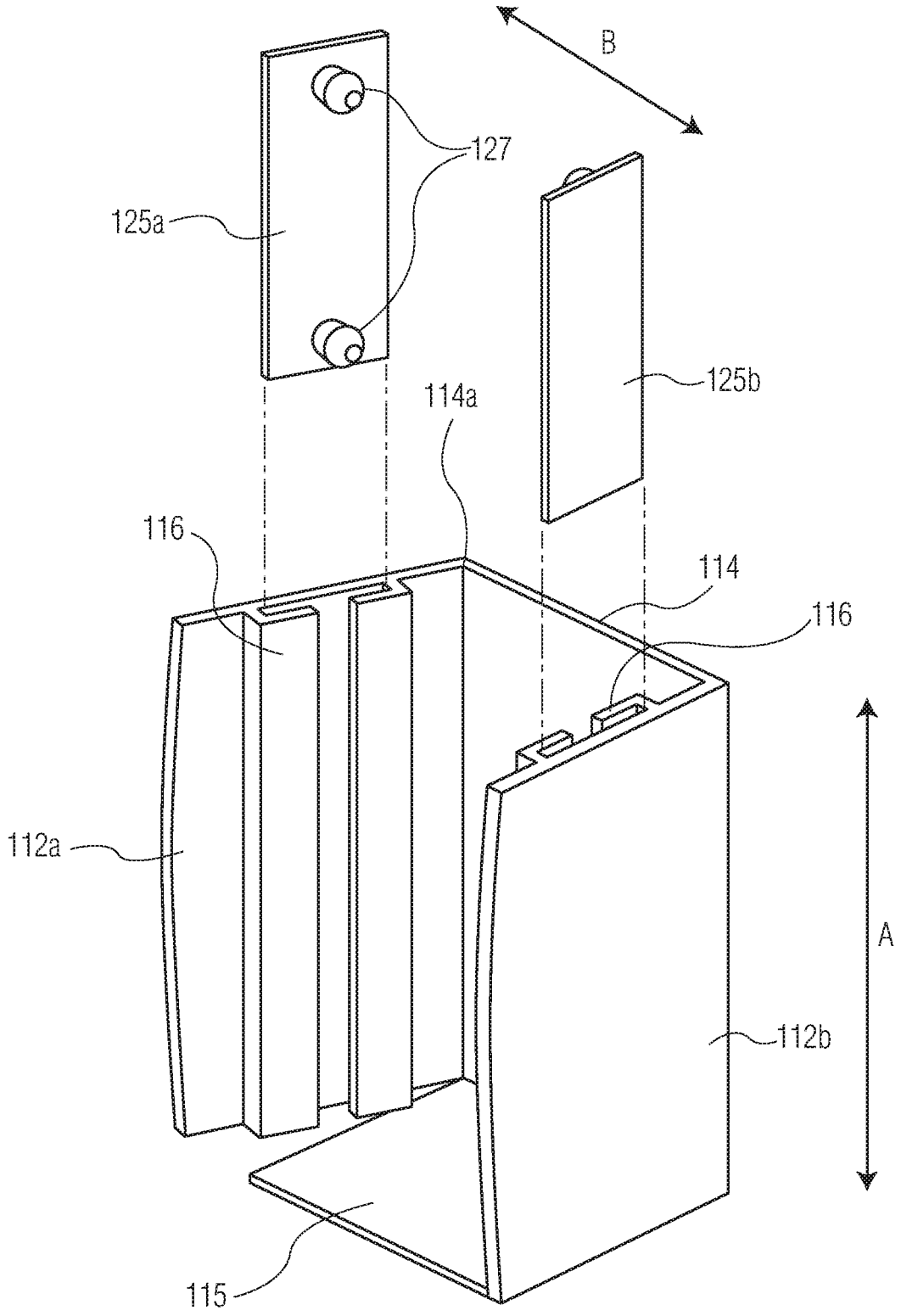
FIG. 2 is a representation of an example paper product dispenser partially disassembled.

In some implementations one or both sides 112 is/are movably attached to the housing 108. For example, as shown in FIG. 2, the side 112*a* is pivotally attached to the back cover 114 at corner 114*a* through, for example, a living hinge or other type of pivoting or hinged connection. In some implementations, the other side 112*b* is (or both sides 112*a*, 112*b* are) movably (or removably) attached to the housing 108 (e.g., pivotally attached to the back cover 114 or the bottom side 115 or one or both sides 112 can be completely detached and re-attached for roll loading purposes).

One or both sides 112 include a vertical track 116 on the interior portion of the sides 112 (e.g., the portion of the sides 112 facing each other and in the direction of the product holding area 110). The vertical tracks 116 function to engage a support device 125 to allow the support device 125 to move up and down (in the vertical axis A) and restrict the side-to-side movement of the support device 125 (along the horizontal axis B). In some implementations, the vertical tracks 116 are a slot or channel extending across at least a portion of the side(s) 112 along the vertical axis A, and the support device 125 is a sled or insert matched to the vertical tracks 116 to be inserted into and held by the vertical tracks 116. For example, if the vertical tracks 116 include a channel having a channel opening with a particular cross section then the support device 125 can have a cross section matched to that of the channel opening such that the support device 125 can slide into and along the channel enables the vertical movement.

Figure 3:
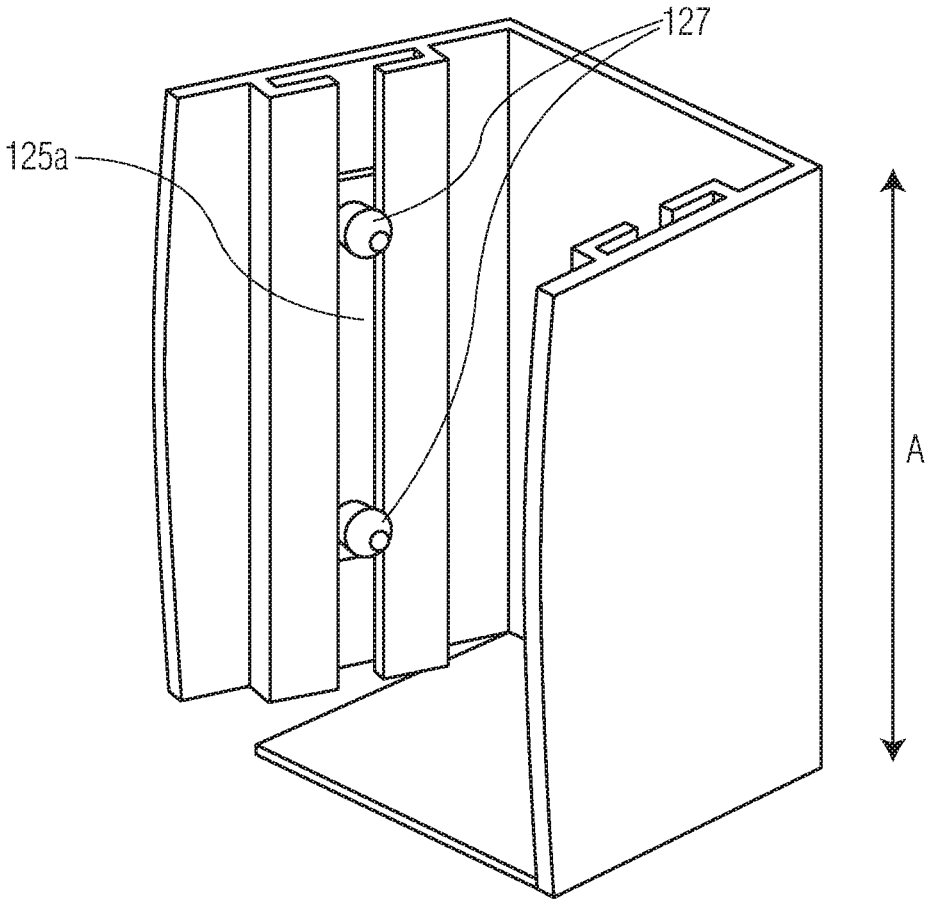
FIG. 3 is a representation of an example paper product dispenser with a support device.

As shown in FIG. 2, the support device 125 can include a left brace 125*a* and a right brace 125*b*, which engage respective left and right vertical tracks 116. Such engagement is shown in FIG. 3, which allows the left brace 125*a* and a right brace 125*b* (not shown) to slide up and down the vertical tracks 116 along the vertical axis A.

In some implementations, the support device 125 includes nubs 127 or protrusions 127 to engage and hold/support the rolls 102. For example, each of the left brace 125*a* and a right brace 125*b* can include two nubs 127, vertically offset from one another. The upper nubs 127 can hold the upper roll 102*a* and the lower nubs 127 can hold the lower roll 102*b* by engaging the respective cores of the rolls 102 (e.g., for a given roll 102, a right nub 127 engaging the right side of the core 151 and a left nub 127 engaging the left side of the core 151).

Figure 4:
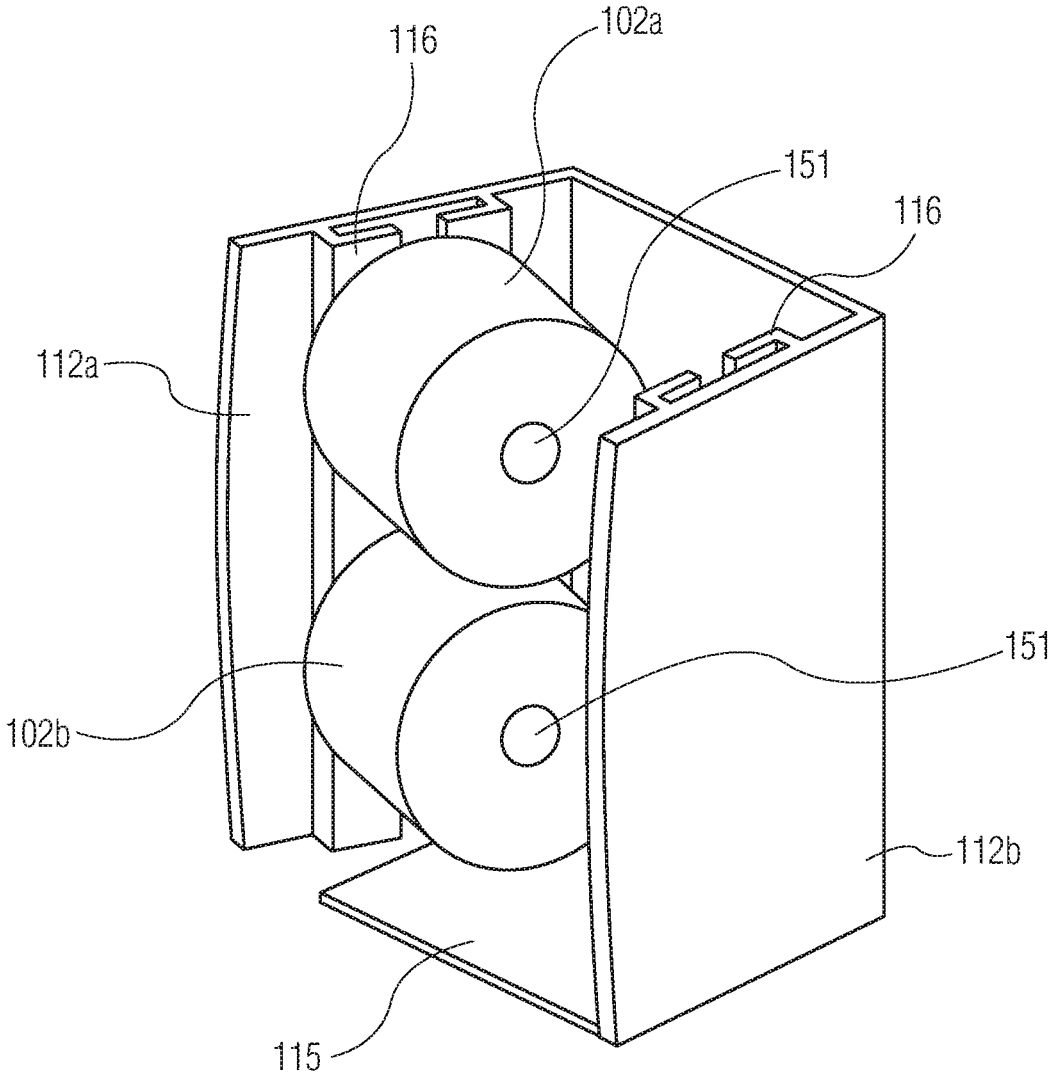
FIG. 4 is a representation of an example paper product dispenser with paper product in a loading configuration.
Figure 5:
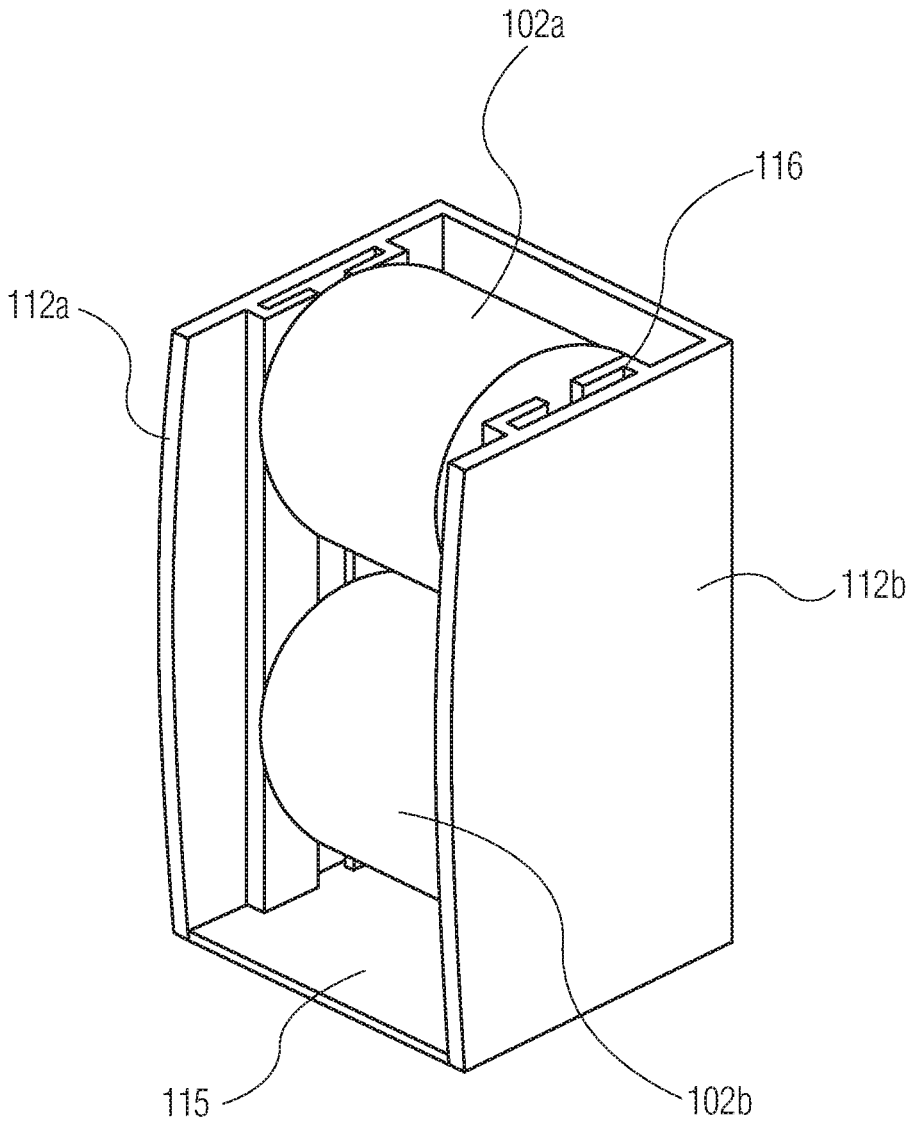
FIG. 5 is a representation of an example paper product dispenser with paper product in a loaded configuration.

In some implementations, one of the sides 112 pivots open (e.g., away from the product holding area 110) to allow the rolls 102 to be pressed into the respective nubs 127 on that side 112, as shown in FIG. 4 in an "open" state. That side 112 can then be pivoted back towards the product holding area 110, as shown in FIG. 5 in a "closed" state, to cause the nubs 127 on the other side to engage the other sides of the cores 151. The side 112 (e.g., 112*a*) can be held in the closed state, for example, through a friction fit with the bottom side 115.

In some implementations, only the left brace 125*a* or right brace 125*b* has nubs 127. In this configuration the nubs 127 can extend further into the core 151 to support the core 151 (and the entire roll 102) from one side 112. Further, in some implementations, the support device 125 only includes a left brace 125*a* or right brace 125*b* and only one side 112 includes a vertical track 116 (e.g., side 112*a* to hold the left brace 125*a* or side 112*b* to hold the right brace 125*b*).

Figure 6A:
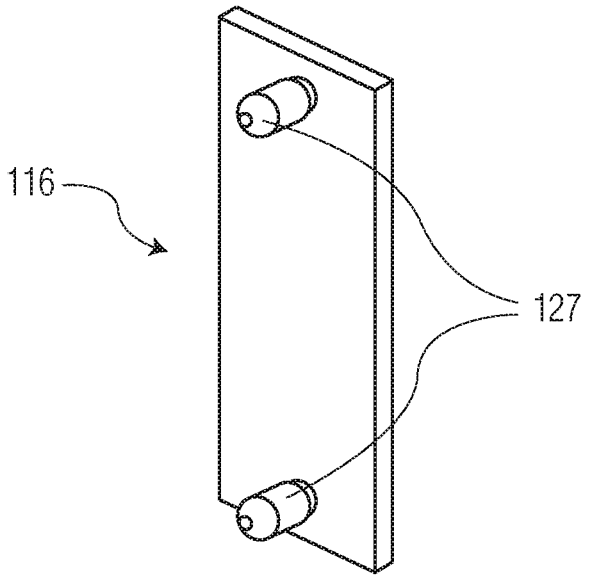
FIGS. 6A-6D are representations of example support devices.
Figure 6B:
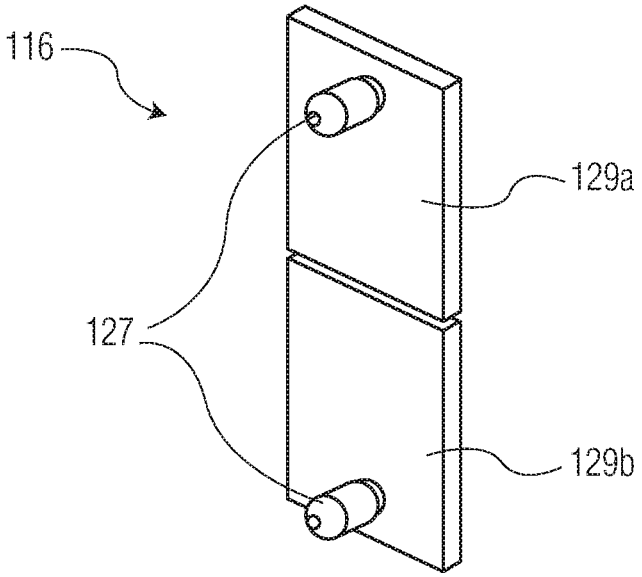
Figure 6C:
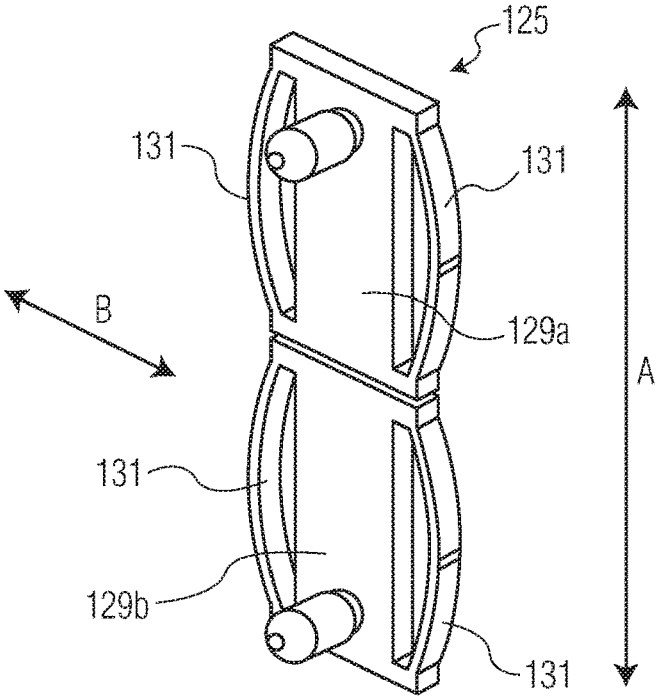
Figure 6D:
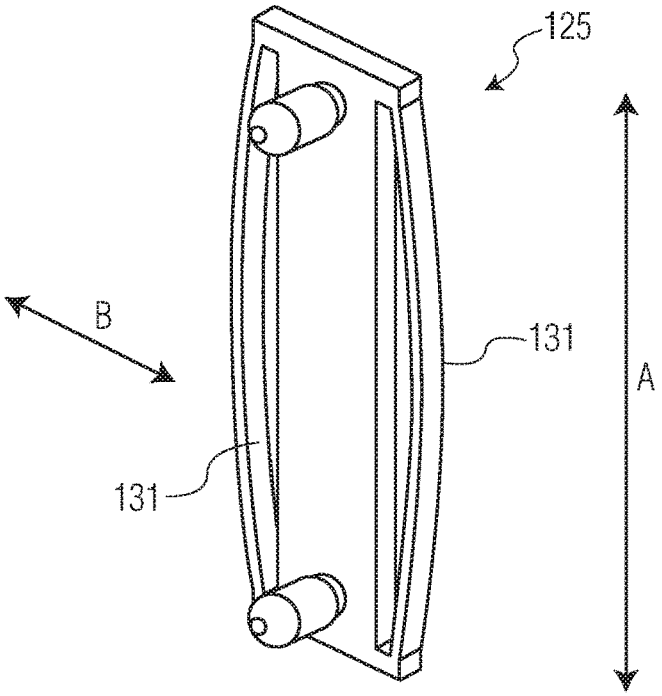

In some implementations, the support device 125 includes an upper roll holder 129*a* and a separate lower roll holder 129*b* for each of the left brace 125*a* and/or right brace 125*b*, as shown in FIG. 6B, as opposed to the single piece brace 125 shown in FIG. 6A. In some implementations, whether for a single piece brace (e.g., 125*a* or 125*b*) or a brace with upper and lower roll holders 129, the braces/holders can include a resilient extension 131 along a portion or all of the side(s) of the braces/holders (e.g., extending in along axis A) that is deformable along the axis B. In this way the support devices 125 can exert pressure in the vertical track channels 116 to slightly resist vertical movement of the support devices 125 when inserted into the tracks 116. Such resistance reduces the tendency, for example, of the support devices 125 to slide out the bottom of the vertical tracks 116 when the side(s) 112 is/are in the open state.

Figure 7A:
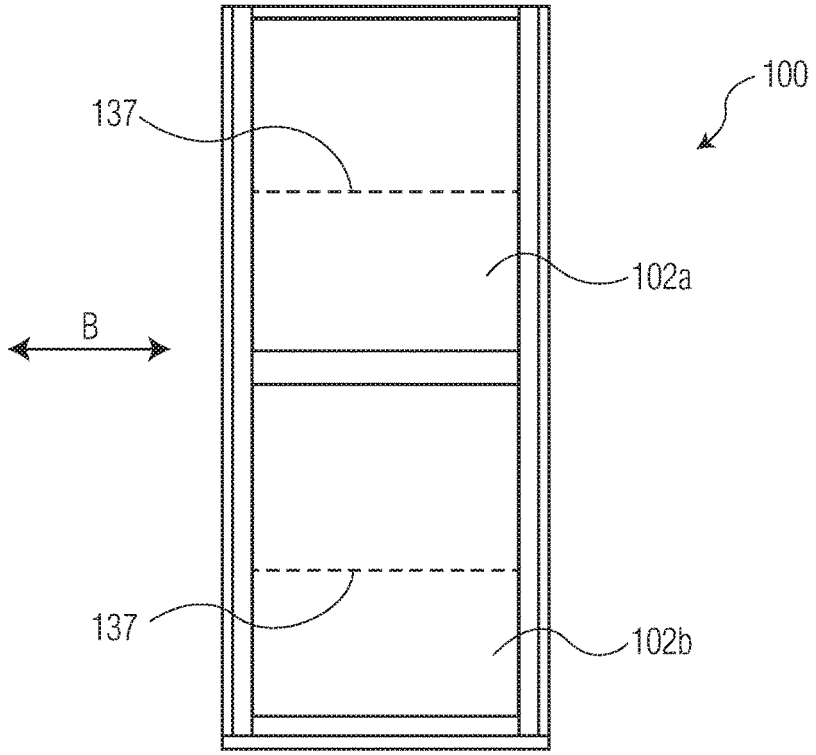
FIGS. 7A-7D are cutaway representations of example paper product dispensers with various amounts of paper depleted.
Figure 7B:
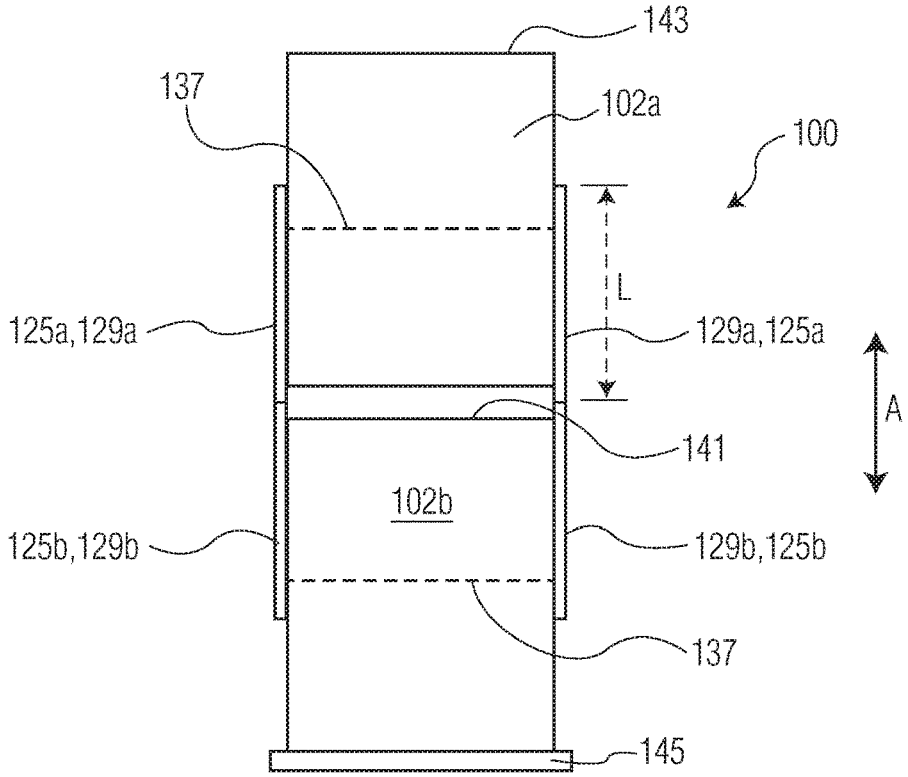

FIG. 7A is a front cutaway representation (i.e., looking in the direction of line C of FIG. 1) of an example paper product dispenser 100 with two full rolls 102*a*, 102*b*. FIG. 7B is a front cutaway representation of the example paper product 100 dispenser showing the upper and lower roll holders 129*a*, 129*b*.

In some implementations, when the respective roll 102 is, for example, full or at least 75 percent full, the left and/or right braces 125 of the upper roll holder 129*a* extend from at least a center 137 of the first roll 102*a* towards a bottom 139 of the first roll 102*a*. In some implementations, when the respective roll 102 is, for example, full or at least 75 percent full, the left and/or right braces 125 of the lower roll holder 129*b* extend from at least a center 137 of the second roll 102*b* towards a top 141 of the second roll 102*b*. In these Figures, the nubs 127 would be proximate the center 137 to engage the cores 151 of the rolls 102.

In some implementations, when the respective roll 102 is, for example, full or at least 75 percent full, the left and/or right braces 125 of the upper roll holder 129*a* can extend further from the center 137 of the first roll 102*a* towards the bottom 139 of the first roll 102*a* than from the center 137 of the first roll 102*a* towards the top 143 of the first roll 102*a*. Additionally or alternatively, the left and/or right braces 125 of the lower roll holder 129*b* can, when the respective roll 102 is full or at least 75 percent full for example, extend further from the center 137 of the second roll 102*b* towards the top 141 of the second roll 102*b* than from the center 137 of the second roll 102*b* towards the bottom 145 of the second roll 102*b*.

In some implementations, a majority of a length of the lower roll holder 129*b* is above the center 137 of the second roll 102*b*, when the roll 102*b* is full. Additionally or alternatively to the lower roll holder 129*b*, a majority of the length of the upper roll holder 129*a* is above the center 137 of the first roll 102*a* when the roll 102*a* is full. For both roll holders 129, the length (L) of the roll holder 129 is measured along axis A and a majority is at least fifty percent of the length and more preferably at least sixty percent of the length.

Figure 7C:
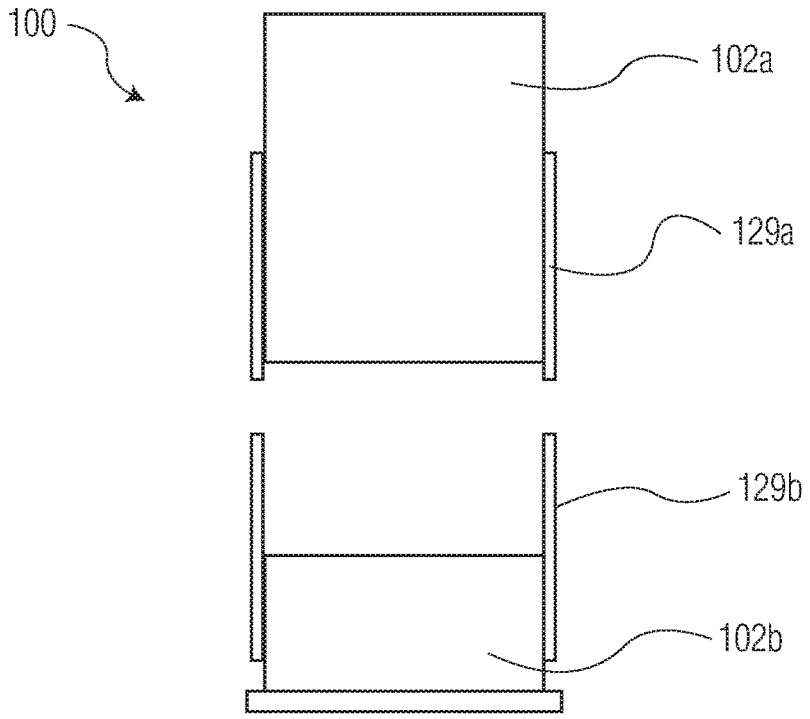
Figure 7D:
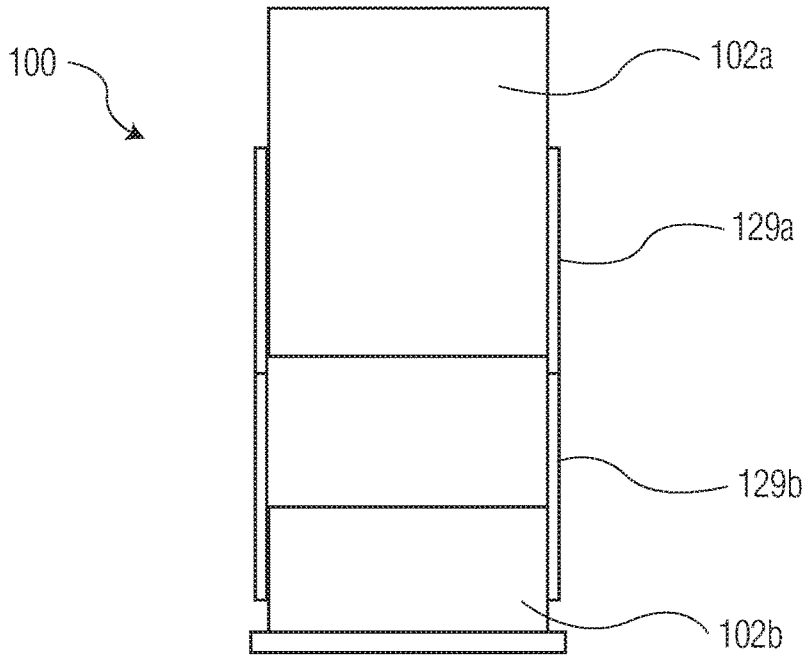

FIG. 7C is a front cutaway representation of the example paper product 100 dispenser showing second roll 102*b* approximately halfway depleted. Given that the second roll 102*b* supports its own weight (e.g., by resting on the bottom 115) as the second roll 102*b* depletes lower roll holder 129*b* accordingly drops towards the bottom 115. As the upper roll holder 129*a* rests on the lower roll holder 129*b* (e.g., as shown in FIG. 7B), the upper roll holder 129*a* and the first roll 102*a* corresponding drop as shown in FIG. 7D. In this way, the first roll 102*a* is lowered into a dispensing position for ease of access by a user as the second roll 102*b* depletes and is eventually depleted (e.g., the dispensing position is generally a position towards the bottom 115 and, for example, out (or partially out) from underneath any front cover 101 to the extent required for a user to access the first roll 102*a*).

Figure 8A:
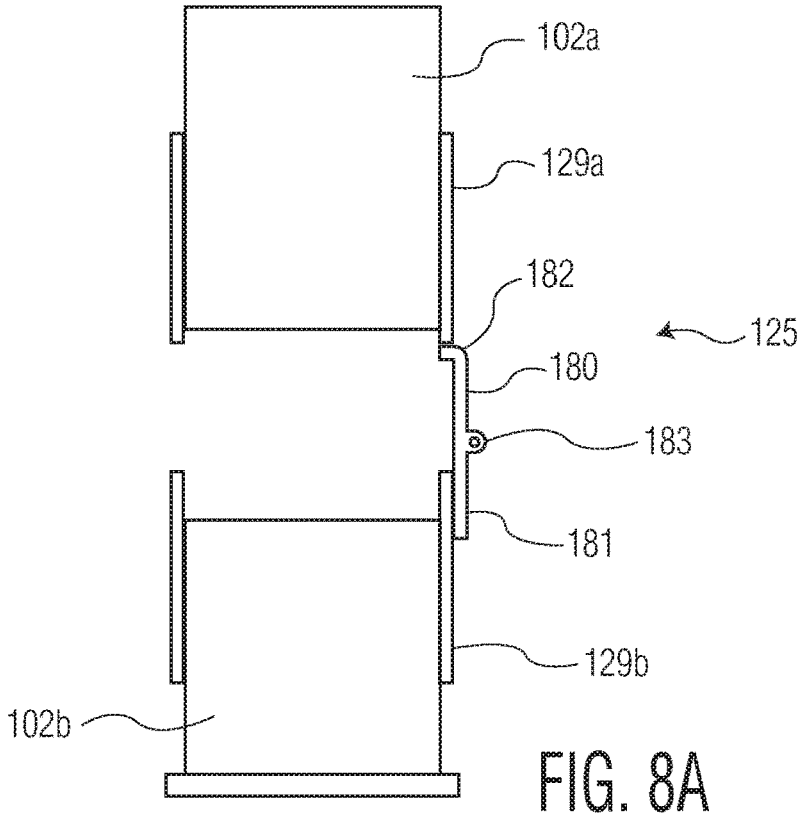
FIGS. 8A-8B are cutaway representations of another example support device.

FIG. 8A is a front cutaway representation of another example support device 125. This support device 125 includes an arm 180 with a lower end 181, an upper end 182 and a pivot point 183. The arm 180 functions to prevent the first roll 102*a* from dropping down towards bottom 115 until the second roll 102*b* has depleted to a specified level (e.g., dictated by the configuration and placement of the arm 180). In operation, the lower end 181 and upper end 182 are rotatable around the pivot point 183. The lower arm 181 is biased (e.g., by a spring) towards the center of the dispenser 100 but is held back by the lower roll holder 129*b* (e.g., when the second roll 102*b* is, for example, full or greater than 50% full or greater than 25% full). As long as the lower end 181 is held back, the upper end 182 engages the upper roll holder 129*a* to prevent the upper roll holder 129*a* from dropping down (e.g., from gravity).

Figure 8B:
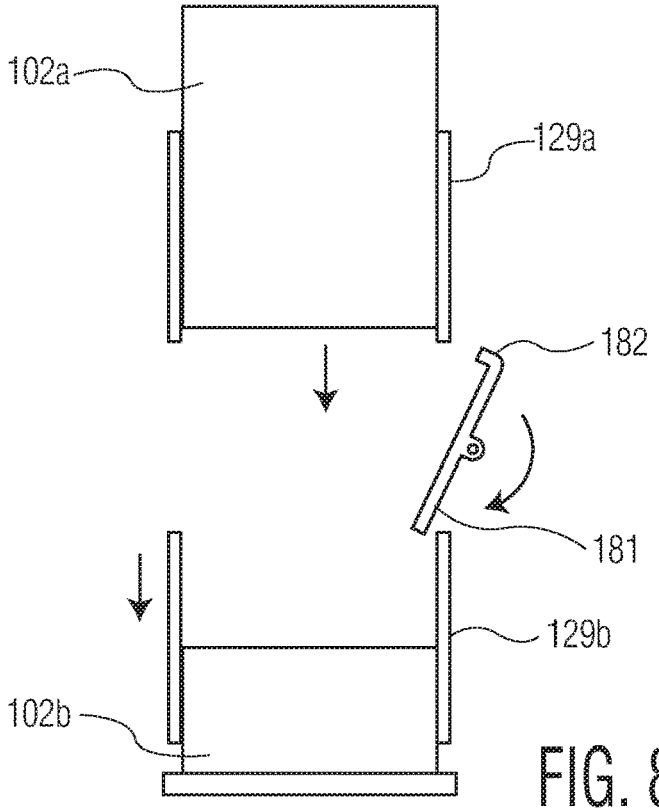

When the second roll 102*b* is sufficiently depleted (e.g., more than 50% or more than 75% or more than 90% depleted), the lower arm 181 will pivot inward toward the center of the dispenser 100 causing the upper arm 182 to pivot outward (away from the center of the dispenser 100) and disengage the upper roll holder 129*a*, which allows the upper roll holder 129*a* and the first roll 102*a* to drop down (e.g., into a dispensing position) as shown in FIG. 8B.

In some implementations, the support device 125 includes a roll periphery device that is biased against and rests on the periphery of the second roll 102*b* (the periphery transverse to the axis of the core 151) so that it moves towards the core 151 as the roll 102*b* depletes. For example, the roll periphery device includes a top portion that rests on the roll 102*b* and a bottom portion that, when the second roll 102*b* is full, supports and lifts the bottom of the lower roll holder 129*b*, and a pivot in between the top and bottom portions around which they rotate. As the second roll 102*b* depletes the top portion follows the periphery of the roll 102*b* (moving towards the roll's core), which causes the bottom portion to move out from under the lower roll holder 129*b*. At a specified point (e.g., based on the dimensions of the roll periphery device) the bottom portion will fully move out from under the lower roll holder 129*b* so that the second roll 102*b* and lower roll holder 129*b* drop down towards the bottom of the dispenser 100. In turn, the first roll 102*a* and upper roll holder 129*a* will also move down (e.g., to be more accessible to a user as the second roll 102*b* depletes).

EMBODIMENTS

Embodiment 1. A paper product dispenser comprising a housing comprising a back, two sides, and a product holding area defined by the back and two sides, wherein each of the two sides includes a vertical track and wherein one of the two sides is movably attached to the housing; and a support device configured to movably engage the vertical tracks of the first and second sides and to support a first roll and a second roll, vertically offset from one another, in the product holding area.

Embodiment 2. The paper product dispenser of embodiment 1, wherein the one of the two sides movably attached to the housing is pivotally attached to the back.

Embodiment 3. The paper product dispenser of embodiments 1 or 2, wherein the support device comprises an upper roll holder and a separate lower roll holder.

Embodiment 4. The paper product dispenser of embodiment 3, wherein each of the upper roll holder and lower roll holder include respective left and right braces with the left and right braces of the upper roll holder are configured to extend from a center of the first roll towards a bottom of the first roll and the left and right braces of the lower roll holder configured to extend from a center of the second roll towards a top of the second roll.

Embodiment 5. The paper product dispenser of embodiment 4, wherein the left and right braces of the upper roll holder are configured to extend further from the center of the first roll towards the bottom of the first roll than from the center of the first roll towards a top of the first roll.

Embodiment 6. The paper product dispenser of embodiment 5, wherein the left and right braces of the lower roll holder are configured to extend further from the center of the second roll towards the top of the second roll than from the center of the second roll towards a bottom of the second roll.

Embodiment 7. The paper product dispenser of embodiment 3, wherein each of the upper roll holder and lower roll holder include a respective brace slideably engaged to the vertical track with the brace of the upper roll holder configured to extend from a center of the first roll towards a bottom of the first roll and the brace of the lower roll holder configured to extend from a center of the second roll towards a top of the second roll.

Embodiment 8. The paper product dispenser of embodiment 7, wherein the brace of the upper roll holder is configured to extend further from the center of the first roll towards the bottom of the first roll than from the center of the first roll towards a top of the first roll, and the brace of the lower roll holder is configured to extend further from the center of the second roll towards the top of the second roll than from the center of the second roll towards a bottom of the second roll.

Embodiment 9. A paper product dispenser comprising a housing comprising a back, two sides, and a product holding area defined by the back and two sides, wherein at least one of the two sides includes a vertical track and wherein one of the two sides is movably attached to the housing; and a support device configured to movably engage the vertical track and to support a first roll and a second roll, vertically offset from one another, in the product holding area.

Embodiment 10. The paper product dispenser of embodiment 9, wherein the one of the two sides movably attached to the housing is pivotally attached to the back.

Embodiment 11. A paper product dispenser comprising a housing comprising a back, two sides, and a product holding area defined by the back and two sides, wherein at least one of the two sides includes a vertical track; a support device configured to movably engage the vertical track and to support a first roll and a second roll, vertically offset from one another, in the product holding area, and wherein the support device comprises an upper roll holder to hold the first roll and a separate lower roll holder to hold the second roll; and wherein a majority of a length of the upper roll holder is below a center of the first roll and a majority of a length of the lower roll holder is above a center of the second roll.

Embodiment 12. The paper product dispenser of embodiment 11, wherein the first and second rolls are bath tissue rolls.

Embodiment 13. The paper product dispenser of any of embodiments 11 or 12, wherein the housing comprises a bottom side and the bottom side includes a ridge along at least a portion of the width of the bottom side.

Embodiment 14. The paper product dispenser of any of embodiments 11-13, wherein one of the two sides is movably attached to the housing.

Embodiment 15. The paper product dispenser of embodiment 14, wherein the one of the two sides is pivotally attached to the back.

Embodiment 16. The paper product dispenser of embodiment 14, wherein the one of the two sides is pivotally attached to the bottom side.

Embodiment 17. The paper product dispenser of any of embodiments 11-16, wherein each of the two sides includes a vertical track.

Embodiment 18. The paper product dispenser of any of embodiments 11-17, wherein the majority of the length of the upper roll holder is below the center of the first roll, when the first roll if full, and the majority of the length of the lower roll holder is above the center of the second roll, when the second roll if full.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments.

This written description does not limit the invention to the precise terms set forth. Thus, while the invention has been described in detail with reference to the examples set forth above, those of ordinary skill in the art may effect alterations, modifications and variations to the examples without departing from the scope of the invention.

What is claimed is:

1. A paper product dispenser comprising:

a housing comprising a back, two sides, a bottom side and a product holding area defined by the back, the bottom side and two sides, wherein each of the two sides includes a vertical track and wherein one of the two sides is movably attached to the housing; and a support device configured to movably engage the vertical tracks of the two sides and to support a first roll and a second roll, vertically offset from one another, in the product holding area, wherein the support device is further configured to hold the second roll to rest on the bottom side, and the support device includes a resilient and deformable extension along at least a portion of a side of the support device and the extension is configured to engage at least one of the vertical tracks.

2. The paper product dispenser of claim 1, wherein the one of the two sides movably attached to the housing is pivotally attached to the back.

3. The paper product dispenser of claim 1, wherein the support device comprises an upper roll holder and a separate lower roll holder.

4. The paper product dispenser of claim 3, wherein each of the upper roll holder and lower roll holder include respective left and right braces with the left and right braces of the lower roll holder configured to extend from a center of the second roll towards a top of the second roll.

5. The paper product dispenser of claim 4, wherein the left and right braces of the upper roll holder are configured to extend further from a center of the first roll towards a bottom of the first roll than from the center of the first roll towards a top of the first roll.

6. The paper product dispenser of claim 4, wherein the left and right braces of the lower roll holder are configured to extend further from the center of the second roll towards the top of the second roll than from the center of the second roll towards a bottom of the second roll.

7. The paper product dispenser of claim 3, wherein each of the upper roll holder and lower roll holder include a respective brace slideably engaged to the vertical track with the brace of the upper roll holder configured to extend from a center of the first roll towards a bottom of the first roll and the brace of the lower roll holder configured to extend from a center of the second roll towards a top of the second roll.

8. The paper product dispenser of claim 7, wherein the brace of the lower roll holder is configured to extend further from the center of the second roll towards the top of the second roll than from the center of the second roll towards a bottom of the second roll.

9. A paper product dispenser comprising:

a housing comprising a back, bottom side, two sides, and a product holding area defined by the back and two sides, wherein at least one of the two sides includes a vertical track and wherein one of the two sides is movably attached to the housing; and a support device configured to movably engage the vertical track and to support a first roll and a second roll, vertically offset from one another, in the product holding area, wherein the support device is further configured to hold the second roll to rest on the bottom side, and the support device includes a resilient and deformable extension along at least a portion of a side of the support device and is configured to engage the vertical track.

10. The paper product dispenser of claim 9, wherein the one of the two sides movably attached to the housing is pivotally attached to the back.

11. A paper product dispenser comprising:

a housing comprising a back, two sides, a bottom side, and a product holding area defined by the back and two sides, wherein at least one of the two sides includes a vertical track;

a support device configured to movably engage the vertical track and to support a first roll and a second roll, vertically offset from one another, in the product holding area, and wherein the support device comprises an upper roll holder to hold the first roll and a separate lower roll holder to hold the second roll;

wherein a majority of a length of the lower roll holder is above a center of the second roll, and wherein the support device is further configured to hold the second roll to rest on the bottom side, and the support device includes a resilient and deformable extension along at least a portion of a side of the support device and is configured to engage the vertical track.

12. The paper product dispenser of claim 11, wherein the first and second rolls are bath tissue rolls.

13. The paper product dispenser of claim 11, wherein one of the two sides is movably attached to the housing.

14. The paper product dispenser of claim 13, wherein the one of the two sides is pivotally attached to the back.

15. The paper product dispenser of claim 13, wherein the one of the two sides is pivotally attached to the bottom side.

16. The paper product dispenser of claim 11, wherein each of the two sides includes a vertical track.

17. The paper product dispenser of claim 11, wherein the majority of the length of the lower roll holder is above the center of the second roll, when the second roll is full.

18. The paper product dispenser of claim 11, wherein a majority of a length of the upper roll holder is above a center of the first roll.

* * * * *